US006889925B2

(12) United States Patent
Gaetano

(10) Patent No.: US 6,889,925 B2
(45) Date of Patent: May 10, 2005

(54) SUPPORT TUBE FOR WINDING YARN ON A BOBBIN

(75) Inventor: Marotti Ing. Gaetano, Vicenza (IT)

(73) Assignee: Riviera Berica S.R.L., Vicenza (IT)

( * ) Notice: Subject to any disclaimer, the term of this patent is extended or adjusted under 35 U.S.C. 154(b) by 0 days.

(21) Appl. No.: 10/183,745

(22) Filed: Jun. 26, 2002

(65) Prior Publication Data

US 2004/0000610 A1 Jan. 1, 2004

(51) Int. Cl.[7] ..... B65H 75/28
(52) U.S. Cl. ..... 242/125.1; 242/476.6; 242/475; 242/118.3; 242/474.7
(58) Field of Search ..... 242/125.1, 476.6, 242/475, 118.3, 474.7

(56) References Cited

U.S. PATENT DOCUMENTS 3,488,010 A * 1/1970 Parry ..... 242/125.1
3,767,129 A * 10/1973 Sobel ..... 242/476.6
4,050,645 A * 9/1977 Burchette et al. ..... 242/125.1
4,050,646 A * 9/1977 Burchette, Jr. ..... 242/125.1
4,063,696 A * 12/1977 Kelly et al. ..... 242/125.1
4,160,532 A * 7/1979 Demuth et al. ..... 242/125.1
4,369,933 A * 1/1983 Bedenbaugh ..... 242/125.1
4,936,523 A * 6/1990 Powel et al. ..... 242/125.1
5,248,111 A * 9/1993 Teckentrup et al. ..... 242/125.1
5,791,574 A * 8/1998 Hastings ..... 242/476.6
5,927,637 A * 7/1999 Gerhards ..... 242/476.6
6,595,456 B2 * 7/2003 Rummage ..... 242/476.6

* cited by examiner

*Primary Examiner*—Kathy Matecki
*Assistant Examiner*—Evan Langdon
(74) *Attorney, Agent, or Firm*—Bucknam and Archer

(57) ABSTRACT

A support tube for winding yarn on a bobbin made of cardboard or another material suitable for the purpose and with a cylindrical or frustum of cone form. Such a tube is characterized in that it is equipped, on its side surface, with at least two indentations or attaching or capturing the end of the thread to be wound on the support itself.

2 Claims, 3 Drawing Sheets

SUPPORT TUBE FOR WINDING YARN ON A BOBBIN

BACKGROUND OF THE INVENTION

The invention concerns a support tube for winding yarn on a bobbin.

As is known, the manufacture of synthetic and artificial textile fibres can take place with different procedures but which all have in common the extrusion step, with which, through a spinneret equipped with capillary holes, the melted product, by coagulation or by cooling, is transformed into bands of elementary thread which constitute the so-called "filament" or yarn.

The yarn thus produced therefore needs to be wound onto a suitable support for forming the bobbin. Consisting of a tubular body, defined with the generic term "tube" and realized in cardboard or in another material suitable for the purpose, which is equipped on its side surface with an indentation for attaching or intercepting the end of the yarn to be wound on the support itself and where both the interception of the yarn and it subsequent winding on the tubular body take place with per se known automatic devices substantially resembling winding reels rotating on their own longitudinal axis, on which the tube to be wound is threaded.

Such a yarn-capturing indentation can take on different configurations, according to the characteristics of the yarn to be wound, all of which however can be sorted into three types:

- yarn-gathering cut: consists of a circumferential cut, in which, the section of the groove has at least one first angular portion with a wider profile, which is used to capture the end of the yarn, and at least one remaining portion with a thinner profile, which is used to block the yarn itself, preventing sliding on the side surface and thus allowing its regular winding on the support.
- simple notch, possibly equipped with a yarn-blocking slit: consists of an opening, which engages the entire thickness of the tubular support body and has a profile in which at least one oblique portion is formed, specifically slightly inclined with respect to the direction perpendicular to the longitudinal axis of the tubular body and having the function of easing the interception and attaching of the end of the yarn on the body itself. A slit can be associated with the oblique portion which engages the yarn and blocks it preventing it from sliding on the side surface and therefore allowing its regular winding on the support.
- window notch, possibly equipped with a yarn-blocking cut: consists of a simple notch formed completely inside the side surface of the tube and thus equipped with a closed perimeter with which is, possibly, associated a circumferential cut which has the task of blocking the yarn, to allow its regular winding on the support.

At the current state of the art the yarn-gathering indentation, associated or not with a yarn-blocking indentation, is formed on the side surface of the tubular body and more precisely on one of the two edges, or close to one of them, which defines one of the two ends of the side surface of the body itself.

Nevertheless this constructive solution allows the possibility of attaching a single yarn to the tubular body and therefore it is possible to realise the winding of a single hank of wound yarn for every single tube.

Moreover, with said constructive solution of the known type the tube, as well as, obviously, being able to be mounted on winding machines on a single side, is suitable for being mounted only on a winding reel which has a specific direction of rotation, that corresponding to the inclination of the yarn-capturing indentation formed on the tube itself for which reason if winding machines are used with winding reels which rotate with opposite directions of rotation it is necessary to have scored two different types of "tubes", to the great disadvantage of the productivity.

SUMMARY OF THE INVENTION

The object of the present invention is to provide a tube for winding yarn which can be mounted on winding reels, independently from their direction of rotation.

A further object of the invention is to provide a tube for winding yarn which can be threaded on a winding reel on both its sides.

A further, but no less important object of the invention is to provide a tube for winding yarn which allows at least two packages or hanks to be realized on a single support consisting of the tube itself.

A further object of the invention is to provide a tube for winding yarn which ensures a greater productivity (increase in the amount of yarn wound per hour worked) with respect to suchlike known products.

These objects are obtained through the realization of a tube equipped with at least two indentations, formed on its side surface.

A first possible embodiment involves forming two indentations on the side surface of the tube, a first indentation being formed near to or directly on one of the two outer edges of the surface itself and a second indentation being formed still on the same side surface but in an intermediate position between the two aforementioned edges, thus making the simultaneous winding of two hanks on a single support possible.

In the same way, with three indentations, one formed on the edges and the others on the side surface and separated from each other by a third of the height of said surface, it is possible to simultaneously wind three hanks on a single support.

A second possible embodiment involves forming two indentations on the side surface of the tube, each arranged on one of the two outer edges of the surface itself. In such a way the winding of a single hank on a single support can be realized but there is the advantage that the tube can be mounted on the winding reel on either of the two sides.

The invention also provides that the indentations have a profile which is preferably symmetrical with respect to the longitudinal axis of the tube, so as to allow the attaching of the yarn independently of the direction of rotation of the tube itself.

Finally, the invention provides that the indentations have a preferably symmetrical profile with respect to a midpoint plane perpendicular to the longitudinal axis, allowing the tube to be slotted onto the support winding reel, on one or the other side of the tube itself.

BRIEF DESCRIPTION OF THE DRAWINGS

The invention will be better illustrated through the description of some of its possible embodiments, given only as a non-limiting illustrative example, with the help of the attached drawings, in which.

DETAILED DESCRIPTION OF THE INVENTION

Figure 1:
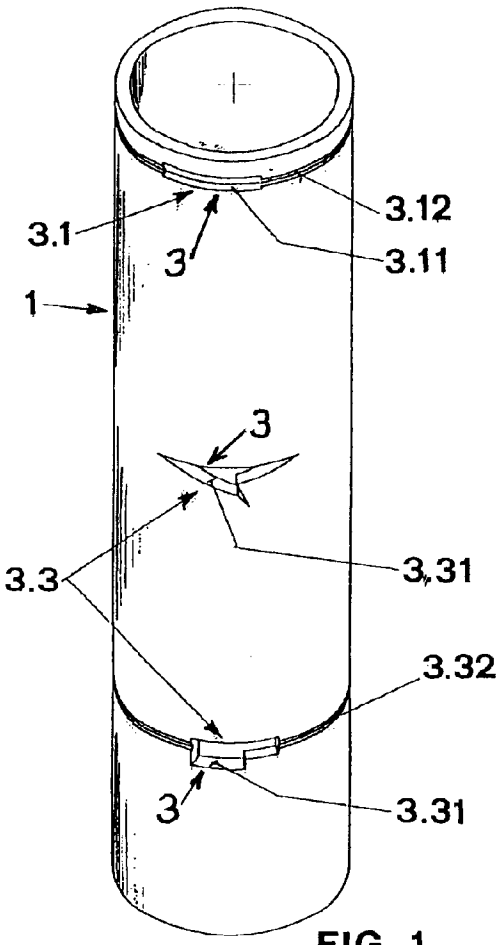
FIG. 1 represents a perspective view of a tube according to the invention, equipped with indentations with different profiles, for attaching the yarn.

As can be seen in FIG. 1, the tube for winding yarn on a bobbin consists of a tubular, cylindrical or frustum of cone body 1, upon the side surface 2 of which indentations 3 are formed in which the end of the wound yarn attaches.

The indentation 3.1, of the yarn-catching type, consists of a circumferential cut in which an angular portion 3.11 has a greater width and depth with respect to the remaining angular portion 3.12.

The indentation 3.2, of the simple notch type, consists of a through-opening equipped with an oblique portion 3.21, to realize the attachment of the yarn and with a slit 3.22 for stopping the yarn itself.

The indentation 3.3, of the window notch type, consists of a through-opening 3.31, for attaching the yarn, possibly associated with a circumferential cut 3.32, for locking the yarn itself.

Figure 3:
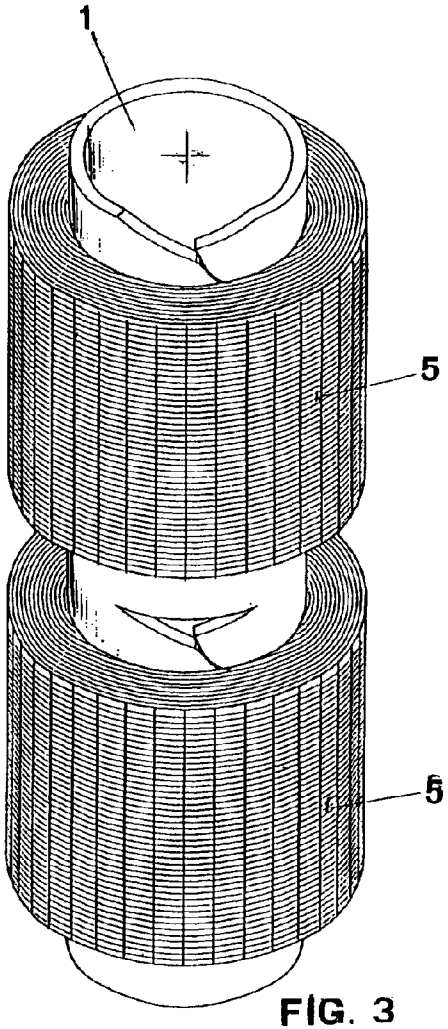
FIG. 3 represents a tube according to FIG. 2 with two wound hanks.
Figure 2:
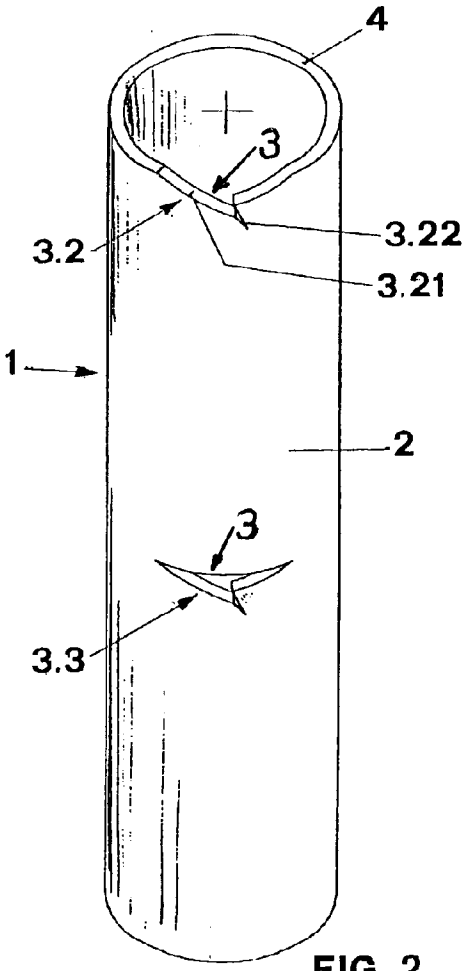
FIG. 2 represents a tube according to the invention equipped with two indentations.

In FIGS. 2 and 3 the tube according to the invention is represented in which the single tubular body 1 is equipped with two indentations, a first sample notch indentation 3.2 formed on the outer edge 4, and a second window notch indentation 3.3 arranged in an intermediate position on the side surface 2, respectively, so as to allow the winding of the two hanks 5 on the same body.

Figure 4:
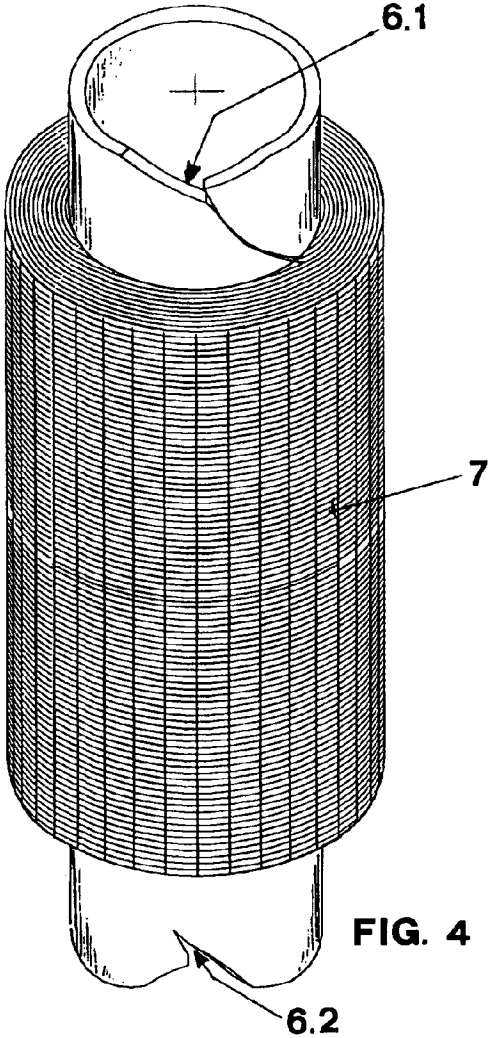
FIG. 4 represents a tube according to the invention equipped with two opposite indentations formed on the outer edges for winding a hank.

In FIG. 4 the tube according to the invention is represented which has two indentations 6.1 and 6.2 formed on the edges, being arranged opposite one another and with symmetrical profiles, so as to allow the winding of the bobbin 7 on both sides of the tube itself.

Figure 5:
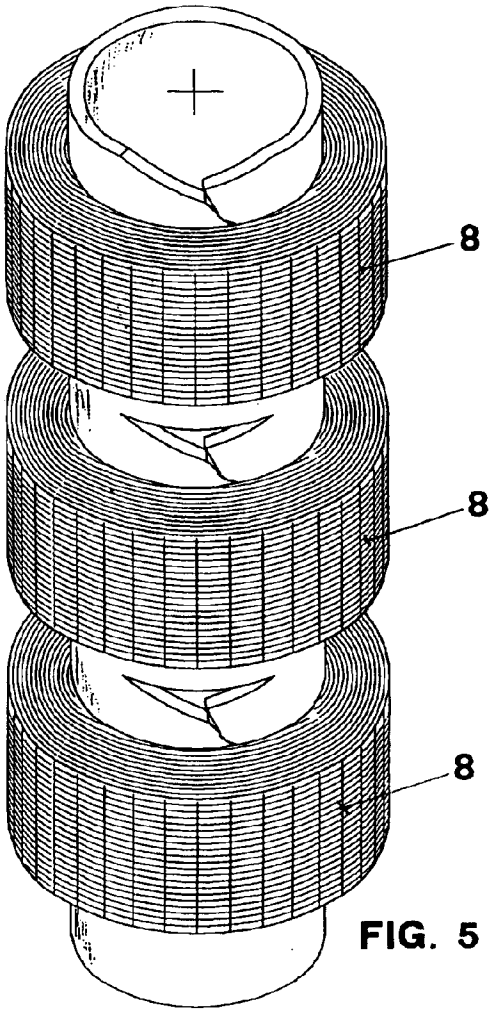
FIG. 5 represents a tube according to the invention with three wound hanks.

In FIG. 5 a tube is represented with three wound bobbins 8.

Figure 6:
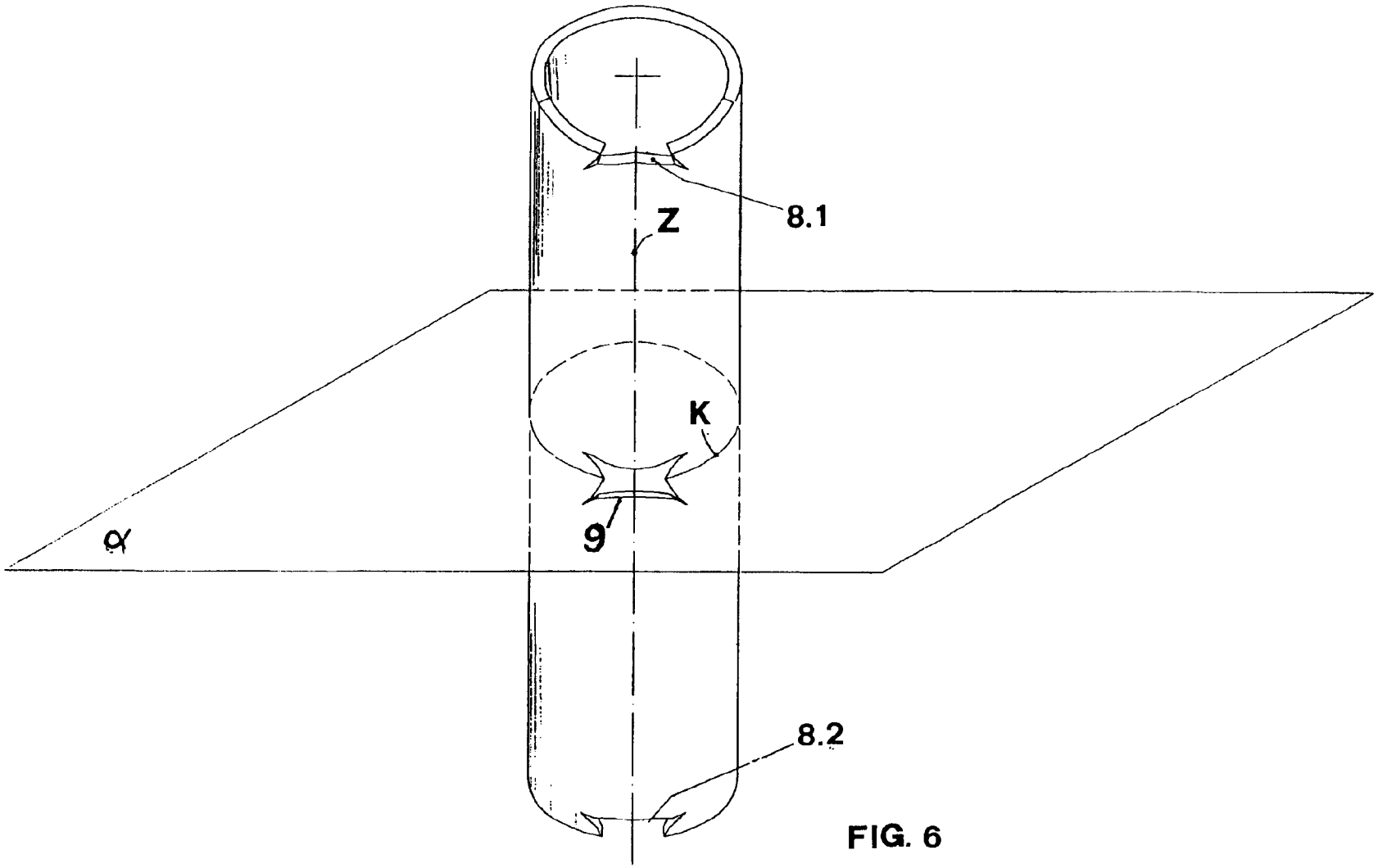
FIG. 6 represents a tube according to the invention equipped with indentations with a symmetrical profile.

In FIG. 6 on the tube three indentations are formed: two indentations 8.1 and 8.2 on the edges and one intermediate indentation 9 on the side surface which have a symmetrical profile with respect to a diametric plane passing through the axis "Z" of the tube, the intermediate indentation also having a symmetrical profile with respect to the plane "$\alpha$", passing through the midpoint line "K" of said indentation and perpendicular to the axis "Z" or the tube itself.

Obviously, different embodiments to those illustrated are also possible, such as different forms of indentation, as well as a different combination thereof on a single body or on a single circumferential arrangement without for this reason leaving the scope of the following claims.

What is claimed is:

1. A support tube for winding yarn thereon formed of cardboard or other suitable material, said support tube having a substantially cylindrical or conical shape, a side surface, a first end extremity and a second end extremity, said support tube further including a first indentation formed on one of said first and second end extremity of said support tube for attaching and intercepting an end of a first yarn to be wound on the support tube and a second indentation on said side surface of said support tube spaced axially from said first indentation for attaching and intercepting an end of a second yarn to be wound on the support tube, whereby two hanks of yarn are formed on said support tube, and wherein said first indentation formed on an end extremity of said support tube is comprised of a through opening in said side surface at said end extremity having a downwardly formed oblique portion extending to a slit for holding the end of the first yarn, and the second indentation formed on the side surface of said support tube is comprised of a through opening in said side surface for holding the end of the second yarn.

2. The support tube for winding yarn thereon as defined in claim 1, which further includes additional indentations of different type and size on said support tube side surface for attaching and intercepting ends of additional yarns to be wound on the support tube, said indentations being spaced axially from one another on said support tube.

* * * * *